US008073173B2

(12) United States Patent
Onodera

(10) Patent No.: US 8,073,173 B2
(45) Date of Patent: Dec. 6, 2011

(54) HEARING AID

(75) Inventor: Kouta Onodera, Miyagi (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/122,607

(22) PCT Filed: Oct. 1, 2010

(86) PCT No.: PCT/JP2010/005921

§ 371 (c)(1),
(2), (4) Date: Apr. 5, 2011

(87) PCT Pub. No.: WO2011/048755

PCT Pub. Date: Apr. 28, 2011

(65) Prior Publication Data

US 2011/0188688 A1 Aug. 4, 2011

(30) Foreign Application Priority Data

Oct. 20, 2009 (JP) ..... 2009-241164

(51) Int. Cl.
*H04R 25/00* (2006.01)

(52) U.S. Cl. ..... 381/323; 381/322

(58) Field of Classification Search ..... 381/312, 381/322–324, 328, 330
See application file for complete search history.

(56) References Cited

U.S. PATENT DOCUMENTS 4,680,799 A 7/1987 Henneberger
2004/0071306 A1 4/2004 Kufner
2007/0177749 A1 8/2007 Sjursen et al.
2010/0098280 A1 4/2010 Sjursen et al.
2010/0119094 A1 5/2010 Sjursen et al.

FOREIGN PATENT DOCUMENTS

CA 1 236 208 5/1988
GB 2 261 108 5/1993
JP 59-228355 12/1984

(Continued)

OTHER PUBLICATIONS

Supplementary European Search Report issued Jul. 26, 2011 in European Application No. EP 10 81 3093.

(Continued)

*Primary Examiner* — Suhan Ni
(74) *Attorney, Agent, or Firm* — Wenderoth, Lind & Ponack, L.L.P.

(57) ABSTRACT

The hearing aid of the present invention comprises a main body case (1), a battery case (7), a control device (14), a microphone (4), a speaker (3), switching part (12, 16), and a lid portion (11*a*). The battery case (7) is provided so that it can be pulled from inside the main body case (1) to the outside of the main body case (1). The control device (14) is actuated by the electromotive force of the air battery (8) held in the battery case (7). The microphone (4) and the speaker (3) are electrically connected to the control device (14). The switching part (12, 16) cuts off the supply of power from the air battery (8) to the control device (14) when the at least part of the battery case (7) is pulled out of the main body case (1). The lid portion (11*a*) is provided either inside the main body case (1) or inside the battery case (7), and air holes (10) in the air battery (8) are opened and closed in conjunction with the operation of pulling at least part of the battery case (7) out of the main body case (1).

5 Claims, 9 Drawing Sheets

FOREIGN PATENT DOCUMENTS

| | | |
|---|---|---|
| JP | 60-14600 | 1/1985 |
| JP | 5-130011 | 5/1993 |
| JP | 2001-238296 | 8/2001 |
| JP | 2001-325997 | 11/2001 |
| JP | 2003-297440 | 10/2003 |
| JP | 2005-129296 | 5/2005 |

OTHER PUBLICATIONS

International Search Report issued Nov. 30, 2010 in International (PCT) Application No. PCT/JP2010/005921.

Written Opinion of the International Searching Authority issued Nov. 30, 2010 in International (PCT) Application No. PCT/JP2010/005921.

HEARING AID

TECHNICAL FIELD

The present invention relates to a hearing aid in which an air battery is installed.

BACKGROUND ART

A conventional hearing aid comprised a main body case, a battery case that is provided so that it can be pulled from inside the main body case to the outside of the main body case, a control device that is actuated by the electromotive force of the air battery held in the battery case, a microphone and a speaker that are electrically connected to the control device, and switching part for cutting off the supply of power from the air battery to the control device when the battery case is pulled out of the main body case. For example, in a so-called storage state, in which the hearing aid is removed from the ear, such as when the user is sleeping, the battery case is pulled out of the main body case when the hearing aid is removed from the ear, whereupon a switching part cuts off the supply of power from the air battery to the control device. Consequently, a conventional constitution suppressed a decrease in the capacity of the air battery.

However, even when the supply of power from the air battery to the control device has been cut off by the switching part, the air battery is still open at its air holes, so the chemical reaction with oxygen continues, and the battery capacity gradually decreases.

For example, Patent Literature 1 discloses a technique in which a switching part is opened and closed by a manipulation member provided to the outer face of the main body case, and the air holes in the air battery are opened and closed with a lid portion.

CITATION LIST

Patent Literature

Patent Literature 1: Japanese Laid-Open Patent Application S59-228355

SUMMARY

However, when the technique disclosed in Patent Literature 1 is applied to a hearing aid, the manipulation member is provided on the outer face of the main body case. Since a compact size is important with a hearing aid, this manipulation member by necessity is also small. However, most hearing aid users are elderly, and it is difficult for them to operate such a small manipulation member, and as a result, the hearing aid is hard to operate.

TECHNICAL PROBLEM

In view of this, it is an object of the present invention to provide a hearing aid with which a decrease in air battery capacity in a storage state is prevented, and the hearing aid is easier to operate when stored.

SOLUTION TO PROBLEM

To achieve the stated object, the hearing aid of the present invention comprises a main body case, a battery case, a control device, a microphone and speaker, a switching part, and a lid portion. The battery case is provided so that it can be pulled from inside the main body case to the outside of the main body case, and houses an air battery. The control device is actuated by the electromotive force of the air battery held in the battery case. The microphone and a speaker are electrically connected to the control device. The switching part cuts off the supply of power from the air battery to the control device in conjunction with the operation of pulling at least part of the battery case out of the main body case. The lid portion is provided inside the main body case or inside the battery case, and opens and closes air holes of the air battery in conjunction with the operation of pulling at least part of the battery case out of the main body case.

ADVANTAGEOUS EFFECTS

As mentioned above, with the present invention, the switching part can cut off the supply of power from the air battery to the control device, and the air holes in the air battery can be covered by the lid portion, merely by pulling at least part of the battery case, which is large enough to be gripped with the fingers, out of the main body case, so there is less of decrease in the capacity of the air battery, and the hearing aid is easier to operate when being stored.

DESCRIPTION OF EMBODIMENTS

The hearing aid pertaining to an embodiment of the present invention will now be described through reference to FIGS. 1 to 7*b*.

Figure 1:
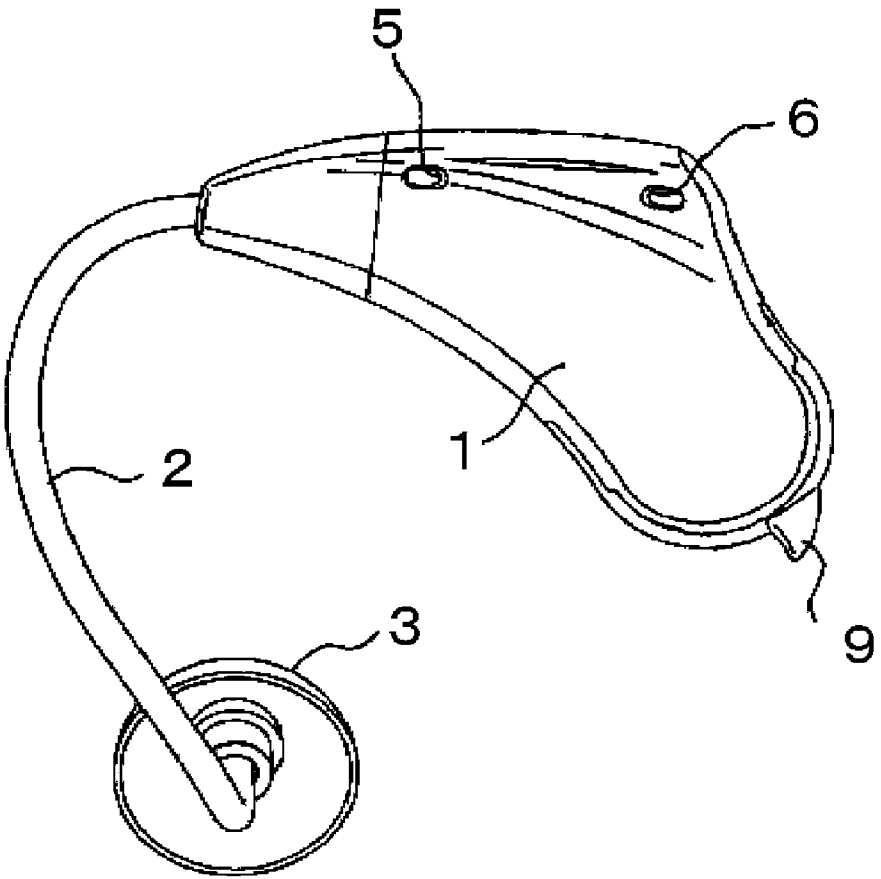
FIG. 1 is a front view of the hearing aid pertaining to an embodiment of the present invention.

The hearing aid of this embodiment, as shown in FIG. 1, is a BTE (behind-the-ear) type of hearing aid, and comprises a main body case 1 that is placed behind the ear, an ear hook 2 that is linked at one end to the upper end side of the main body case 1, and a speaker 3 that is linked to the other end of the ear hook 2.

Figure 2:
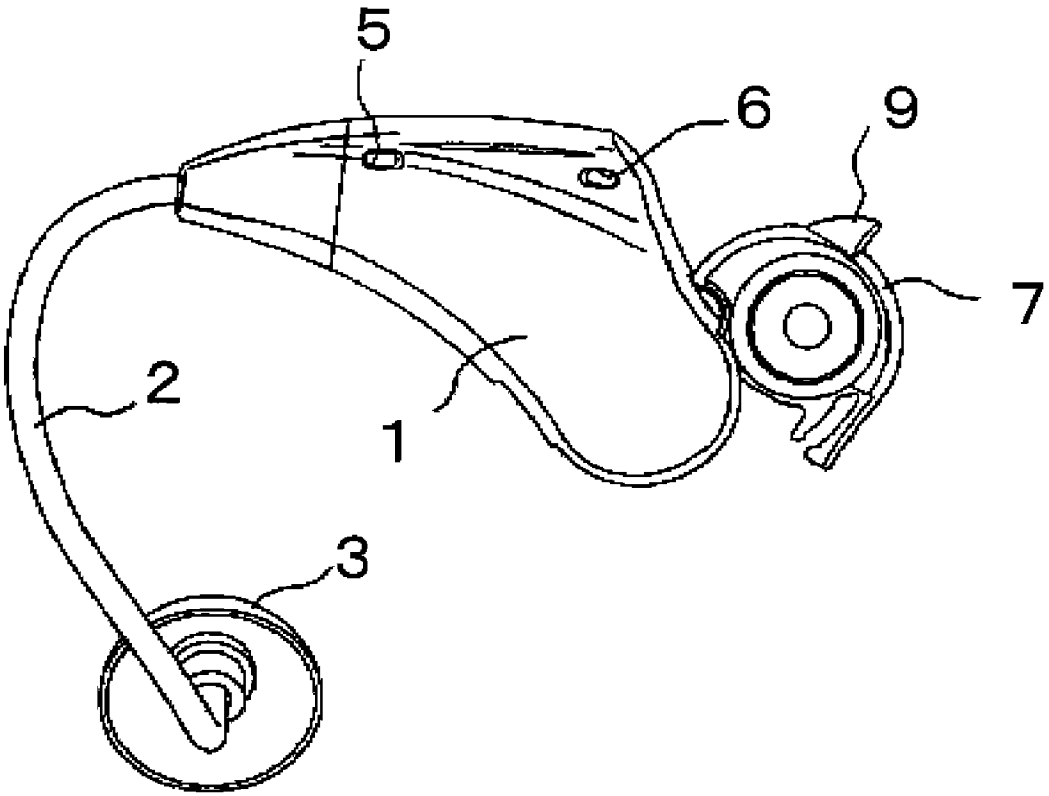
FIG. 2 is a front view of a state in which the battery case of the hearing aid in FIG. 1 has been opened.

Openings 5 and 6 for a microphone 4 (see FIG. 3) are provided to the upper and lower parts in the approximate middle of the main body case 1. As shown in FIG. 2, a battery case 7 is provided inside the lower end of the main body case 1 in a state that allows it to be pulled out of the main body case 1.

Figure 6:
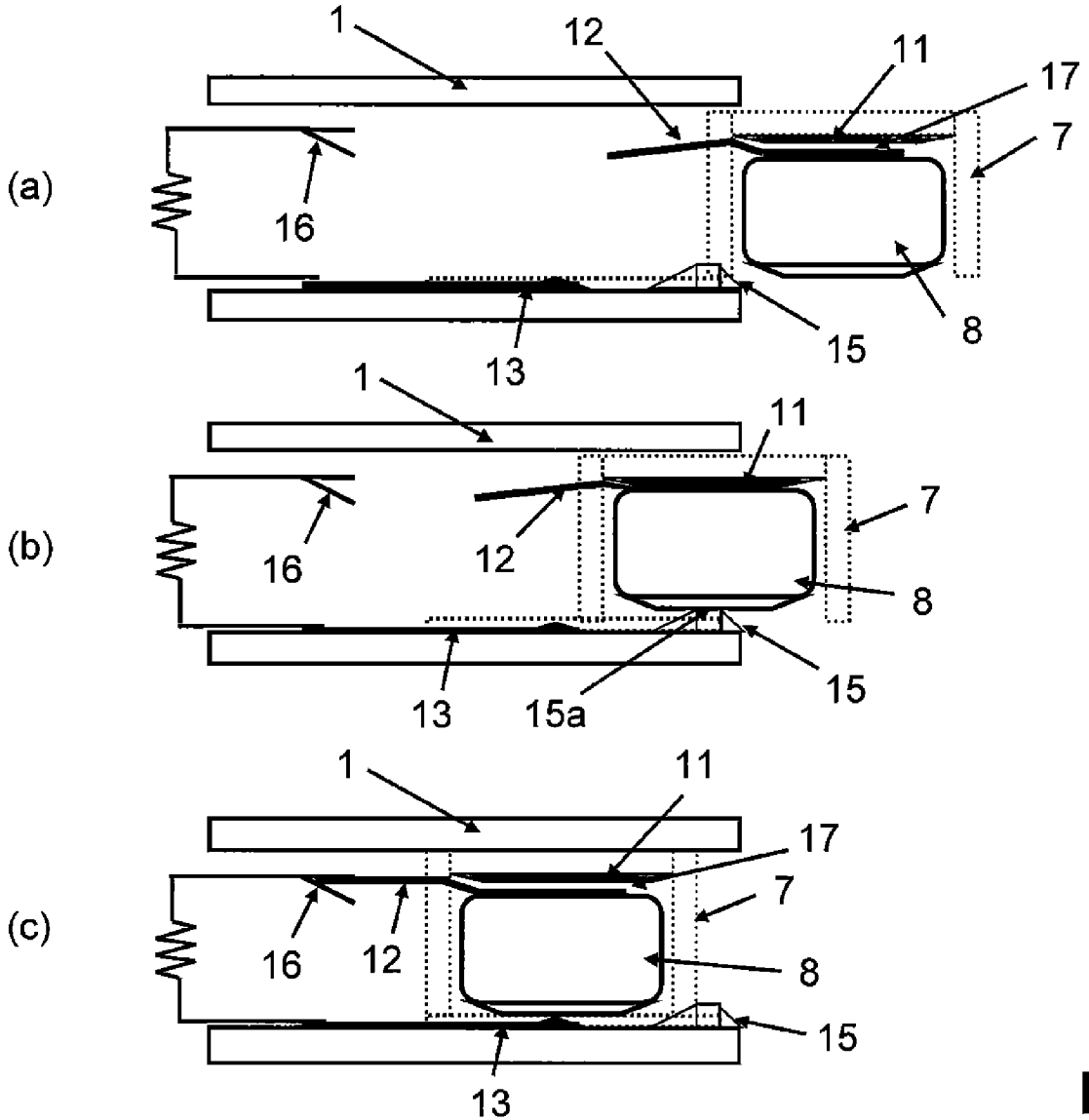
FIGS. 6*a* to 6*c* are diagrams of the operating state of the hearing aid in FIG. 1.
Figure 7:
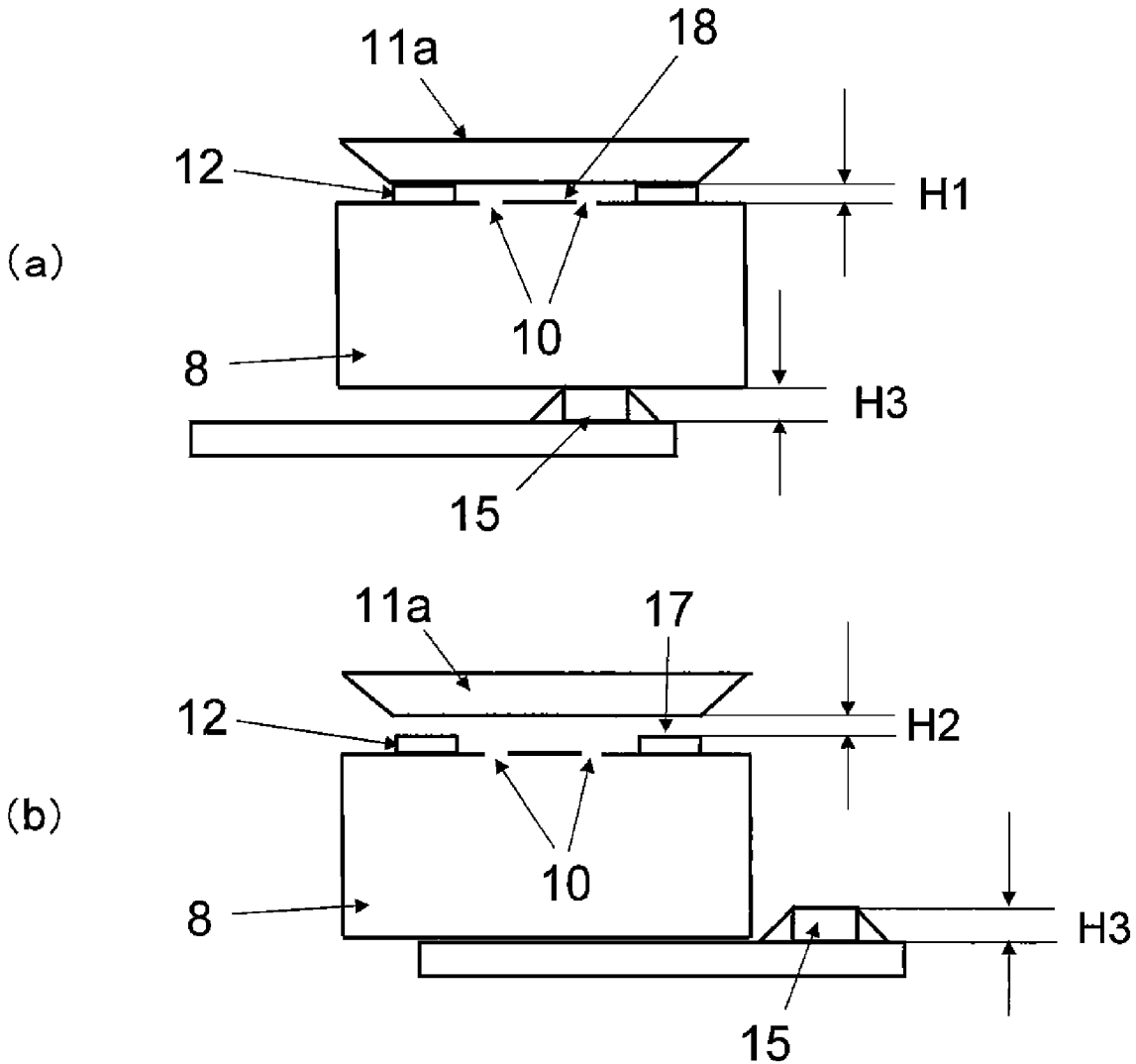
FIGS. 7*a* and 7*b* are diagrams illustrating the use of a hard member for the lid portion of the hearing aid in FIG. 1.

As shown in FIGS. 2 and 6, the battery case 7 is a container that is open on one side (the far side in FIG. 2), and an air battery 8 is housed in the interior thereof The battery case 7 is able to rotate around a rotary shaft (not shown) from the usage state of the hearing aid shown in FIGS.

1 and 6*c* to the state shown in FIGS. 2 and 6*a* in which the battery is replaced. In the transition from the usage state of the hearing aid shown in FIGS. 1 and 6*c* to the state shown in FIGS. 2 and 6*a* in which the air battery 8 is replaced, a lever 9 shown in FIG. 1 is pushed to the right in FIG. 1. As a result, part of the battery case 7 is pulled out of the main body case 1, after which part of the battery case 7 that is exposed outside the main body case 1 is gripped with the fingers and pulled out to the position shown in FIGS. 2 and 6*a*, and in this state the air battery 8 is replaced.

Figure 5:
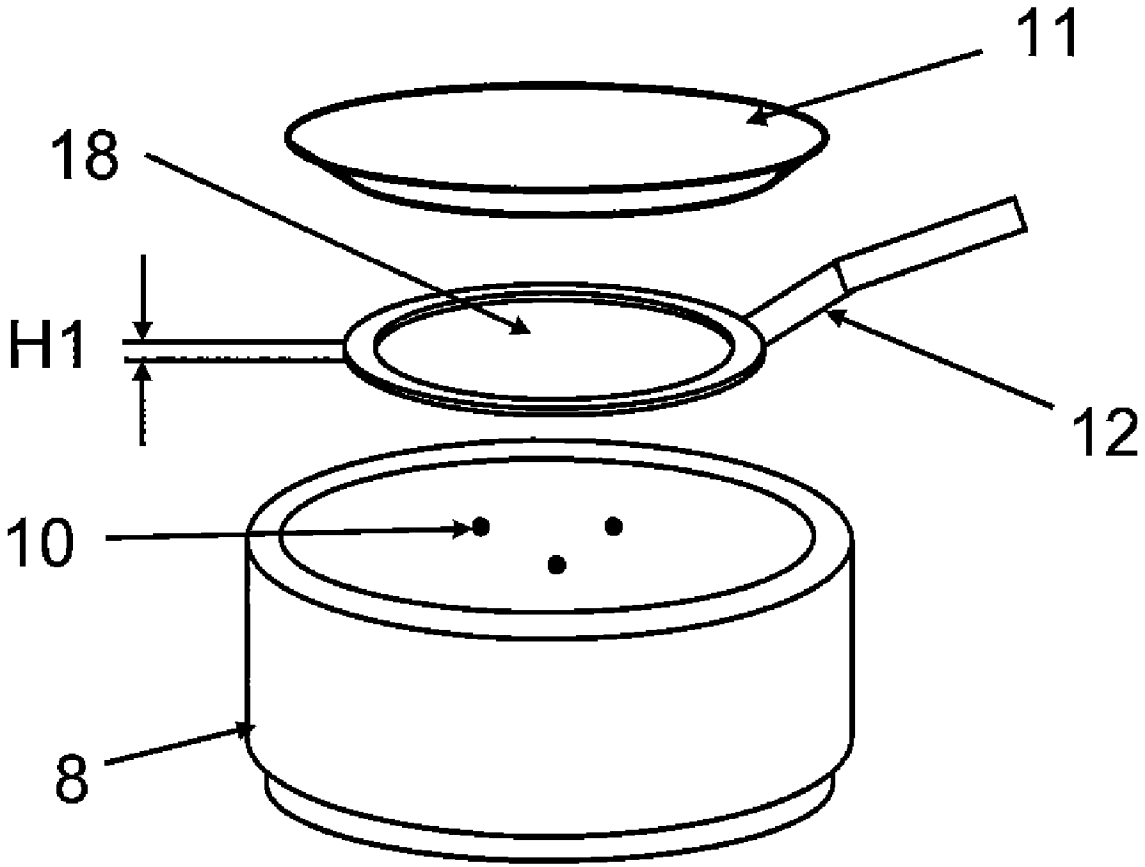
FIG. 5 is an oblique view of the main parts of the hearing aid in FIG. 1.

As shown in FIG. 5 and elsewhere, the air battery 8 is disk-shaped, and has a plurality of air holes 10 provided on one side. Also, as shown in FIGS. 6*a* to 6*c*, the air battery 8 is housed so that the side with the air holes 10 comes into contact with the bottom side of the battery case 7 (in FIGS. 6*a* to 6*c*, the bottom is at the top). In the stowed state shown in FIGS. 6*a* to 6*c*, a lid portion 11 with a spherical surface shape is provided, with its center portion protruding downward in FIGS. 6*a* to 6*c*, to the lowermost side within the battery case 7. As shown in FIG. 5, a ring-shaped power supply terminal (switching part) 12 is provided between the lid portion 11 and the air battery 8. The elasticity of the power supply terminal 12 biases the air battery 8 to the opposite side from the lid portion 11.

Figure 3:
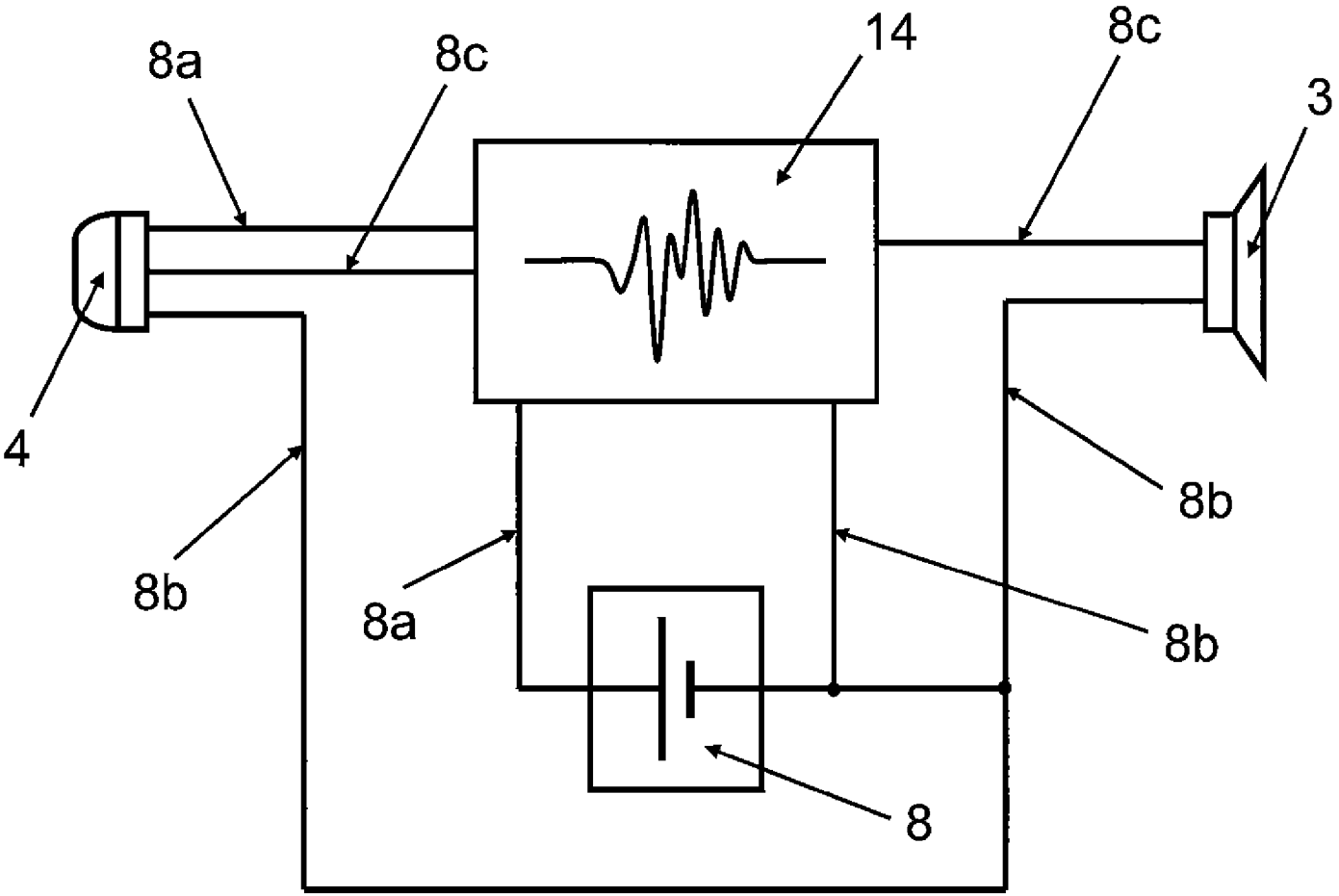
FIG. 3 is a control block diagram of the hearing aid in FIG. 1.
Figure 4:
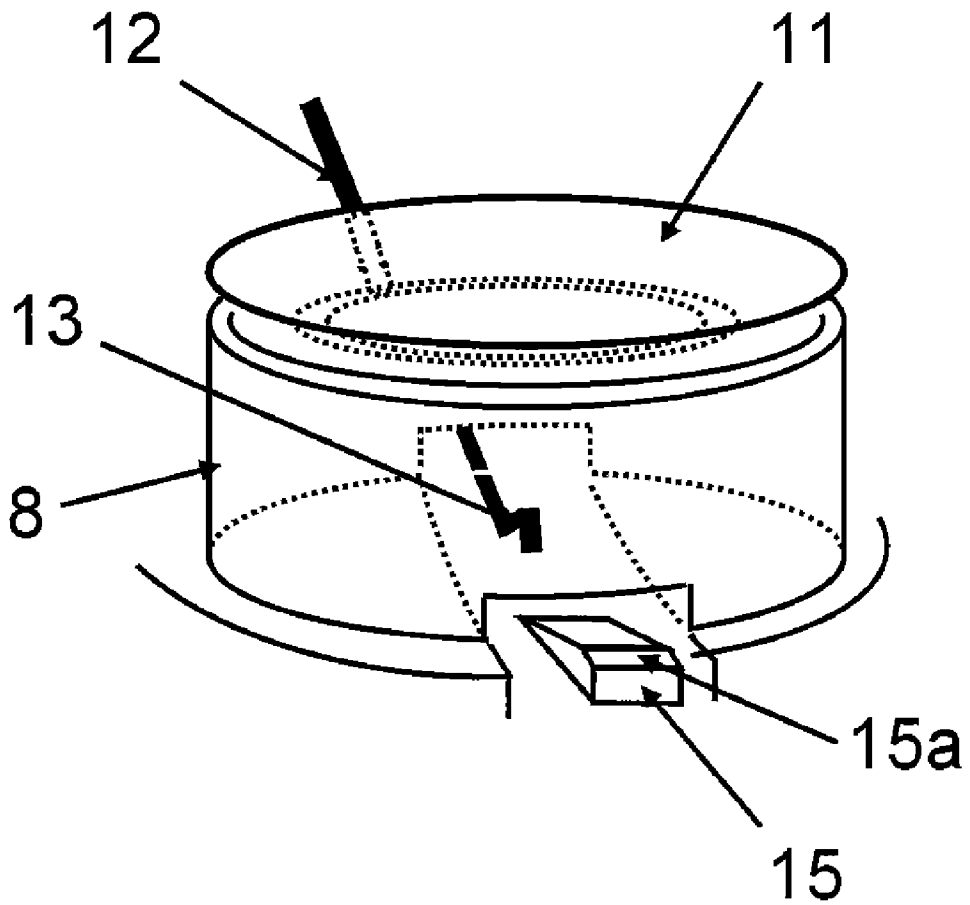
FIG. 4 is an oblique view of the main parts of the hearing aid in FIG. 1.

In other words, when the hearing aid of this embodiment is in the usage state shown in FIG. 6*c*, the power supply terminal 12 biases the air battery 8 to the opposite side from the lid portion 11. As a result, as shown in FIG. 6*c*, the air battery 8 is sandwiched between the power supply terminal 12 and a power supply terminal 13, which are provided to positions opposite each other on the upper and lower faces of the air battery 8. Consequently, as shown in FIG. 3, power supply voltage is supplied from the air battery 8 to a control device 14 housed inside the battery case 7.

Also, in the usage state shown in FIGS. 1 and 6*c*, the air battery 8 is biased by the power supply terminal 12 to the opposite side from the lid portion 11. This forms a gap 17 between the lid portion 11 and the air holes 10 in the air battery 8. In other words, the air holes 10 are in a state of not being uncovered by the lid portion 11, so power is generated when air flows in. Furthermore, as shown in FIG. 3, the control device 14 electrically connects the microphone 4 and the speaker 3 via a power supply wire 8*a*, a ground wire 8*b*, and a signal wire 8*c*.

With the above constitution, FIG. 6*b* shows the hearing aid in a storage state in which part of the battery case 7 has been pulled out of the battery case 7. The "storage state" here refers to a state in which the hearing aid has been removed from the ear at bedtime. Since the hearing aid is not in its usage state at this point, the decrease in the capacity of the air battery 8 must be kept to a minimum.

In view of this, with the hearing aid in this embodiment, as shown in FIGS. 6*a* to 6*c*, a protrusion 15 that protrudes to the air battery 8 side is provided to the edge of the battery case 7 insertion opening in the main body case 1.

The protrusion 15 has a top face 15*a* in its approximate center portion. This top face 15*a* is a flat face. As shown in FIGS. 6*a* to 6*c*, the protrusion 15 has a trapezoidal shape that gradually decreases in height from the approximate center portion where the top face 15*a* is formed toward the two end portions. Consequently, when part of the battery case 7 is pulled out of the main body case 1, the air battery 8 will not snag on the protrusion 15, which affords smooth operation of the battery case 7. In this embodiment, the description is of a protrusion 15 that is trapezoidal in shape, but another shape, such as hemispherical, may be used as long as the shape is such that the height gradually decreases from the center portion of the protrusion 15 (the top face 15*a*) toward the two end portions.

As shown in FIG. 6*b*, part of the battery case 7 is pulled out of the main body case 1, and when the air battery 8 hits the top face 15*a* of the protrusion 15, the air battery 8 is pushed along with the power supply terminal 12 to the lid portion 11 side. Consequently, the air holes 10 in the air battery 8 are blocked by the lid portion 11, so this minimizes the decrease in the capacity of the air battery 8 in the storage state of the hearing aid.

The operating state when a lid portion 11*a* is formed from a hard material such as plastic or resin will be described in detail by giving an example, through reference to FIGS. 7*a* and 7*b*.

FIGS. 7*a* and 6*b* both show the storage state of the hearing aid.

As shown in FIG. 7*a*, the power supply terminal 12 is disposed sandwiched between the lid portion 11*a* and the air battery 8. At this point, because the power supply terminal 12 has a thickness H1, the air holes 10 in the air battery 8 cannot be directly covered by the lid portion 11.

In view of this, with the hearing aid in this embodiment, the portion of the power supply terminal 12 that connects with the air battery 8 is given a ring shape, and this ring-shaped internal space shall be called the space 18, which is sealed off by being sandwiched between the lid portion 11*a* and the air battery 8 above and below. Consequently, the area around the air holes 10 can be a sealed space, so the resulting state is the same as a state in which the air holes 10 are covered. As a result, this effectively minimizes wasted power generation by the air battery 8 when the hearing aid is in its storage state.

As long as it has a hollow part that does not block the air holes 10, the shape of the power supply terminal 12 is not limited to ring-shaped, and may instead be a quadrangular or triangular shape, so long as it has a hollow part in its interior.

FIG. 7*b* shows the operating state of the hearing aid, just as in FIG. 6*c*.

In this state, the gap 17 is formed between the lid portion 11*a* and the power supply terminal 12. Therefore, air is supplied to the air holes 10, and the air battery 8 is in a power generating state.

As discussed above, the protrusion 15 here pushes up the air battery 8 and presses it against the lid portion 11*a* in the storage state of the hearing aid, so that the air holes 10 are covered. In view of this, in this embodiment the height H3 of the protrusion 15 and the size H2 of the gap 17 preferably satisfy the relation $H2<H3$.

Consequently, the air battery 8 is firmly pressed against the lid portion 11*a*, forming the space 18 that is sealed around the periphery of the air holes 10 in the air battery 8. As a result, as discussed above, wasted power generation in the air battery 8 can be effectively curtailed in the storage state of the hearing aid.

As discussed above, with the hearing aid in this embodiment, the air battery 8 rides up onto the top face 15*a* of the protrusion 15, and the air holes 10 (or their surrounding area) of the air battery 8 are covered by the lid portion 11, by a simple operation in which part of the battery case 7 is merely pulled out of the main body case 1.

Consequently, there is less wasted power generation in the air battery 8 when the hearing aid is in its storage state, so the decrease in battery capacity during storage of the hearing aid can be mitigated. Also, in the above-mentioned storage state of the hearing aid, the supply of power from the air battery 8 to the control device 14, the microphone 4, and the speaker 3 is also cut off, so the decrease in battery capacity can be mitigated.

More precisely, in this embodiment, in the hearing aid usage state shown in FIG. 6*c*, the power supply terminal 12 is mechanically and electrically linked to a connector (switching part) 16, and this is how the above-mentioned supply of power to control device 14, the microphone 4, and the speaker 3 is carried out. The elasticity of the power supply terminal 12 biases the air battery 8 to the opposite side from the lid portion 11.

However, in the hearing aid storage state shown in FIG. 6*b*, or the air battery 8 replacement state shown in FIG. 6*a*, the power supply terminal 12 is not mechanically or electrically connected to the connector 16.

Consequently, when the hearing aid is not in its storage state, the supply of power from the air battery 8 to the control device 14, the microphone 4, and the speaker 3 is cut off, and the air battery 8 is not subjected to the force that biases it to the opposite side from the lid portion 11. That is, in this embodiment, the power supply terminal 12 and the connector 16 constitute switching part.

Other Embodiments (A)

In the above embodiment, an example in which a sealed space was formed around the air holes 10 was given as the mode of the lid portion for suppressing the wasted decrease in battery capacity in the storage state of the hearing aid. The present invention is not limited to this, however.

Figure 8:
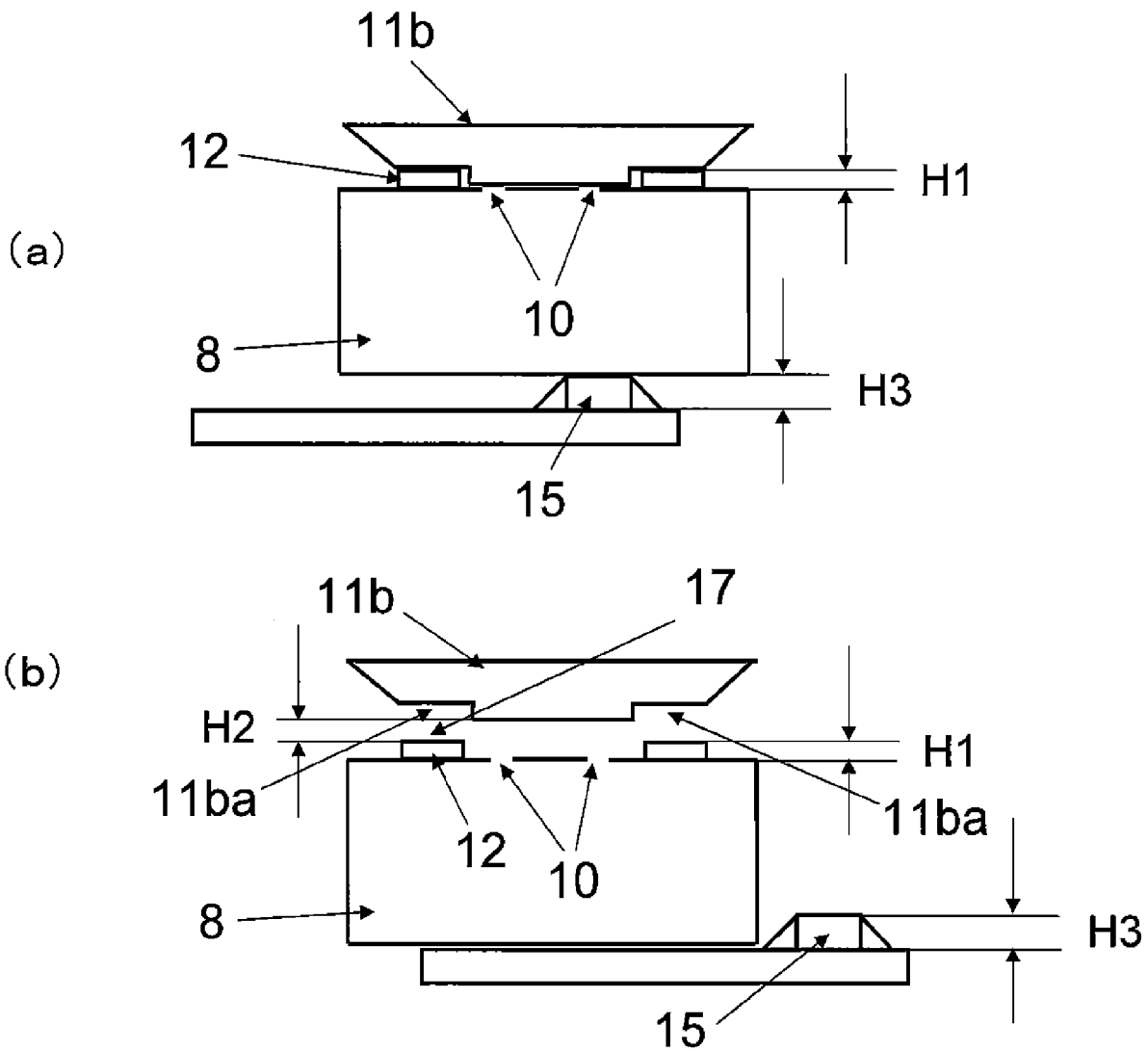
FIGS. 8*a* and 8*b* are diagrams illustrating the use of a hard member for the lid portion of the hearing aid in FIG. 1.

For example, when a lid portion 11*b* is formed from a hard material such as plastic or resin just as in the above embodiment, as shown in FIGS. 8*a* and 8*b*, the same effect as above can be obtained by modifying the shape of the lid portion 11*b*.

Specifically, FIG. 8*a* shows the storage state of the hearing aid, just as in FIG. 6*b*.

As shown in FIG. 8*b*, the lid portion 11*b* has an annular recess portion 11*ba* provided to the portion that comes into contact with the power supply terminal 12. The depth of this recess portion 11*ba* is designed to be greater than the thickness H1 of the power supply terminal 12.

Consequently, as shown in FIG. 8*a*, the air battery 8 will ride up onto the top face 15*a* of the protrusion 15, and the air battery 8 will be pushed along with the power supply terminal 12 to the lid portion 11*c* side. At this point the air holes 10 are covered by the surface of the lid portion 11*b*, so wasted generation of power by the air battery 8 can be reduced in the storage state of the hearing aid.

When the recess portion 11*ba* is thus provided to the lid portion 11*b*, the air holes 10 are directly covered by the lid portion 11*b*. Therefore, the power supply terminal 12 need not be ring-shaped, and may have a U shape without a hollow part, for example.

FIG. 8*b* shows the operating state of the hearing aid, just as in FIG. 6*c*.

In this state the gap 17 is formed between the lid portion 11*b* and the power supply terminal 12. Therefore, air is supplied to the air holes 10, and the air battery 8 is in a power generating state.

As discussed above, the protrusion 15 here pushes up the air battery 8 and presses it against the lid portion 11*b*, so that the air holes 10 are covered. In view of this, the height H3 of the protrusion 15, the length H2 of the gap 17, and the thickness H1 of the power supply terminal 12 preferably satisfy the relation H1+H2<H3.

Consequently, as shown in FIG. 8*a*, the air battery 8 can be firmly pressed against the lid portion 11*b*, and the air holes 10 can be directly covered by the lid portion 11*b*. As a result, wasted power generation in the air battery 8 can be effectively curtailed in the storage state of the hearing aid.

(B)

In the above embodiment, an example in which a sealed space was formed around the air holes 10 was given as the mode of the lid portion for suppressing the wasted decrease in battery capacity in the storage state of the hearing aid. The present invention is not limited to this, however.

For example, the same effect as above can be obtained when a lid portion 11*c* is formed from an elastic member such as a rubber material or silicone material, unlike in the above embodiment.

Figure 9:
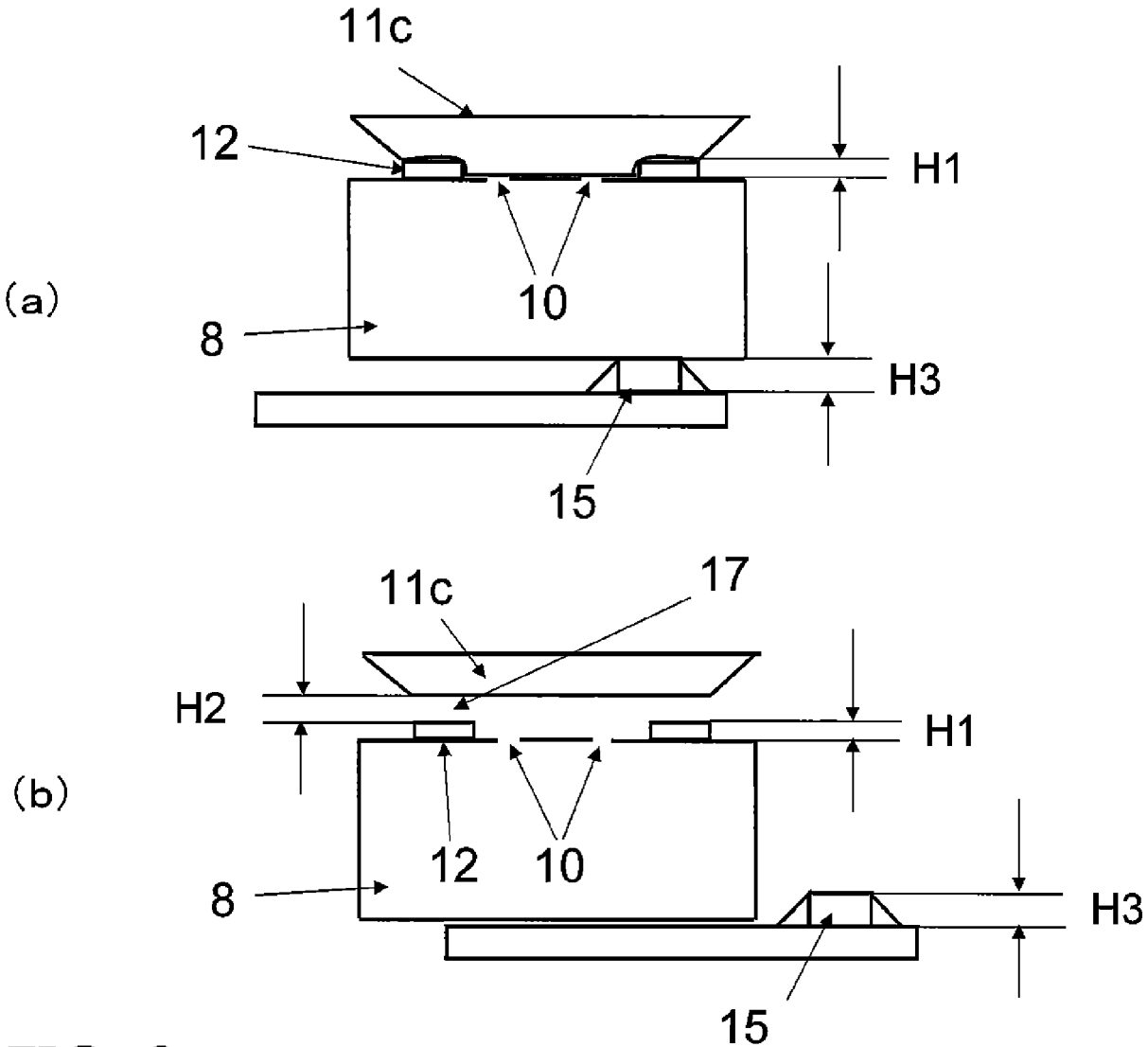
FIGS. 9*a* and 9*b* are diagrams illustrating the use of an elastic member for the lid portion of the hearing aid in FIG. 1.

Specifically, FIG. 9*a* shows the storage state of the hearing aid, just as in FIG. 6*b*.

Here, the lid portion 11*c* is formed from an elastic member, so that when the air battery 8 rides up onto the top face 15*a* of the protrusion 15, and the air battery 8 is pressed along with the power supply terminal 12 to the lid portion 11*c* side, the portion of the lid portion 11*c* that comes into contact with the power supply terminal 12 is deformed in a concave shape by an amount equal to the thickness H1 of the power supply terminal 12.

This allows the air holes 10 to be covered by the surface of the lid portion 11*c*, so wasted power generation by the air battery 8 can be prevented in the storage state of the hearing aid.

Furthermore, when the lid portion 11*c* is made from an elastic member, the lid portion 11*c* can directly cover the air holes 10, so just as in the other embodiment (A) above, the power supply terminal 12 need not be ring-shaped, and may have a U shape without a hollow part, for example.

FIG. 9*b* shows the operating state of the hearing aid, just as in FIG. 6*c*.

In this state the gap 17 is formed between the lid portion 11*c* and the power supply terminal 12. Therefore, air is supplied to the air holes 10, and the air battery 8 is in a power generating state.

As discussed above, the protrusion 15 here pushes up the air battery 8 and presses it against the lid portion 11*c*, so that the air holes 10 are covered. In view of this, the height H3 of the protrusion 15, the length H2 of the gap 17, and the thickness H1 of the power supply terminal 12 preferably satisfy the relation H1+H2<H3.

Consequently, the air battery 8 is firmly pressed against the lid portion 11*c*, so the air holes 10 can be directly covered by the lid portion 11*c*. As a result, power generation in the air battery 8 is halted in the storage state of the hearing aid, and the decrease in capacity of the air battery 8 can be suppressed.

(C)

In the above embodiment, an example was given in which the lid portion 11 was provided inside the battery case 7. However, the present invention is not limited to this.

For example, the lid portion may be provided inside the main body case 1.

INDUSTRIAL APPLICABILITY

With the present invention, at least part of a battery case that is large enough to be gripped by the fingers is merely pulled out from a main body case, whereby a switching part cuts off the supply of power from an air battery to a control device, etc., and air holes in the air battery can be covered by a lid portion, so the decrease in the capacity of the air battery in the storage state of the hearing aid is suppressed, while it is easier for the user to put the hearing aid in its storage state. This means that the present invention should be applicable to a wide range of hearing aids that feature an air battery.

REFERENCE SIGNS LIST

1 main body case
2 ear hook
3 speaker
4 microphone
5, 6 opening
7 battery case
8 air battery
8*a* power supply wire
8*b* ground wire
8*c* signal wire
9 lever
10 air hole
11 lid portion
11*a* lid portion (hard member)
11*b* lid portion (hard member)
11*ba* recess portion
11*c* lid portion (elastic member)
12 power supply terminal (switching part)
13 power supply terminal
14 control device
15 protrusion
15*a* top face
16 connector (switching part)
17 gap
18 space

The invention claimed is:

1. A hearing aid, comprising:

a main body case;

a battery case that is provided so that it can be pulled from inside the main body case to the outside of the main body case, and houses an air battery;

a control device that is actuated by the electromotive force of the air battery held in the battery case;

a microphone and a speaker that are electrically connected to the control device;

switching part configured to cut off the supply of power from the air battery to the control device in conjunction with the operation of pulling at least part of the battery case out of the main body case, a lid portion that is provided inside the main body case or inside the battery case, and opens and closes an air hole of the air battery in conjunction with the operation of pulling at least part of the battery case out of the main body case, and a protrusion that is provided to the main body case and that biases the air battery to the lid portion side in a storage state in which the lid portion is stowed inside the battery case and part of the battery case has been pulled out of the main body case;

wherein the switching part cuts off the power from the air battery to the control device and the lid portion covers the air hole of the air battery in a storage state in which part of the battery case has been pulled out of the main body case.

2. The hearing aid according to claim 1, further comprising a power supply terminal that is provided between the air battery and the lid portion inside the battery case, and that biases the air battery to the opposite side from the lid portion in a usage state in which the battery case is stowed inside the main body case.

3. The hearing aid according to claim 2, wherein the power supply terminal has a hollow part that makes the air hole non-closeable, inside the portion that comes into contact with the air battery.

4. The hearing aid according to claim 1, wherein the lid portion is formed from an elastic member.

5. The hearing aid according to claim 1, wherein the protrusion has a flat top face in the center portion, and is formed so that its height gradually decreases from the top face toward the two ends.

* * * * *